US005538338A

United States Patent [19]

Biggers

[11] Patent Number: 5,538,338

[45] Date of Patent: Jul. 23, 1996

[54] HANDS FREE WASTE CONTAINER CABINET

[76] Inventor: Mark T. Biggers, 4916 Zenith, No. 325, Metairie, La. 70001

[21] Appl. No.: 371,521

[22] Filed: Jan. 10, 1995

[51] Int. Cl.[6] ..... A47B 88/00; A47B 95/02

[52] U.S. Cl. ..... 312/319.9; 312/211; 220/262; 220/263; 220/264; 220/908

[58] Field of Search ..... 312/319.9, 211, 312/212; 220/262, 263, 264, 629, 630, 636, 908, 409

[56] References Cited

U.S. PATENT DOCUMENTS

| | | | |
|---|---|---|---|
| D. 309,810 | 8/1990 | Moore . | |
| D. 328,169 | 7/1992 | Burleigh . | |
| D. 332,334 | 1/1993 | Jones . | |
| D. 332,852 | 1/1993 | Delmerico . | |
| 963,079 | 7/1910 | Sebring | 312/319.9 X |
| 1,130,503 | 3/1915 | Franckaerts | 312/319.9 X |
| 1,315,143 | 9/1919 | Masters | 312/319.9 X |
| 1,791,766 | 2/1931 | Scharf | 312/319.9 X |
| 1,937,337 | 11/1933 | Gaa | 312/211 X |
| 2,533,524 | 12/1950 | Snider | 312/319.9 X |
| 2,615,663 | 10/1952 | Hamilton | 312/319.9 X |
| 2,644,731 | 7/1953 | Davis | 312/319.9 X |
| 3,322,477 | 5/1967 | Armijo | 312/211 |
| 3,443,745 | 5/1969 | Kleeberg | 312/211 X |
| 4,150,764 | 4/1979 | Anderson . | |
| 4,445,619 | 5/1984 | Kubic et al. . | |
| 5,090,785 | 2/1992 | Stamp | 312/319.9 |
| 5,163,579 | 11/1992 | Jones . | |
| 5,213,272 | 5/1993 | Gallagher et al. . | |
| 5,230,525 | 7/1993 | Demerico et al. . | |

*Primary Examiner*—Peter M. Cuomo
*Assistant Examiner*—Rodney B. White
*Attorney, Agent, or Firm*—Joseph N. Breaux

[57] ABSTRACT

An improved waste container cabinet of the type having a storage compartment, for receiving an open topped waste container; a first vertically oriented aperture, located above the open top of the waste container; and a vertically oriented pivoting lid member, disposed within the first vertically oriented aperture. The improvement to the waste container cabinet comprises: the addition of a mechanical mechanism, in mechanical connection with the lid member, for causing the lid member to pivot out of the first vertically oriented aperture and into the storage compartment in a manner such that a user may place refuse within a waste container, disposed within the storage compartment, without contacting the lid member with his/her hands.

3 Claims, 7 Drawing Sheets

HANDS FREE WASTE CONTAINER CABINET

TECHNICAL FIELD

The present invention relates to devices for allowing patrons in a fast-food dining facility to dispose of their own refuse and more particularly to devices and methods for allowing patrons in a fast-food dining facility to dispose of their own refuse without having to contact the waste container cabinet with their hands.

BACKGROUND ART

In a great many eating facilities, such as fast food restaurants and the like, the patrons customarily dispose of the trash left over from their meals. However, it is often a problem to get certain patrons to comply with this custom due to real or perceived hygienic problems associated with the trash disposal devices currently in use. The waste container cabinets generally used have a storage compartment in which an open topped waste container is placed. Trash is deposited into the open topped waste container through a vertically oriented aperture that is located above the open top of the waste container and which has a vertically oriented pivoting lid member disposed within the vertically oriented aperture. In order to dispose of their trash, patrons must push the pivoting lid member into the cabinet with their hands or using the tray upon which the food is served. Because the lid member is often contaminated with food grease, condiments, and soda, some patrons who refuse to touch it and prefer to simply abandon their trash at a table, a counter, or on top of the waste container cabinet.

It would be benefit, therefore, to have a waste container cabinet which allowed patrons dining at such eating facilities to place their trash within the waste container without requiring the patron to touch the vertical lid member of the cabinet. It would be a further benefit if the waste container cabinet was easy to operate, and which has a convenient foot actuated mechanism for pivoting the lid member out of the patrons way when it is desired to dispose of their trash.

General Summary Discussion of Invention

It is thus an object of the invention to provide a hands free waste container cabinet that allows for hands free disposal of refuse.

It is a further object of the invention to provide a hands free waste container cabinet that has a foot actuated, pivoting lid member.

It is a still further object of the invention to provide a hands free waste container cabinet that is simple to construct.

It is a still further object of the invention to provide a hands free waste container cabinet that is simple to operate.

Accordingly, an improved waste container cabinet is provided of the type having a storage compartment, for receiving an open topped waste container; a first vertically oriented aperture, located above the open top of the waste container; and a vertically oriented pivoting lid member, disposed within the first vertically oriented aperture. The improvement to the waste container cabinet comprises: the addition of a mechanical mechanism, in mechanical connection with the lid member, for causing the lid member to pivot out of the first vertically oriented aperture and into the storage compartment in a manner such that a user may place refuse within a waste container, disposed within the storage compartment, without contacting the lid member with his/her hands.

The mechanical mechanism may include a foot pedal extending from a bottom section of the cabinet. When including a foot pedal, the mechanical mechanism causes the lid member to pivot in response to a force directed against the foot pedal in a first direction. The foot pedal preferably includes a mid-section that is pivotal about a first axis in the manner of a lever and fulcrum.

The mechanical mechanism may also include a lid bracket having a connecting arm extending into the storage compartment. The bracket is attached to the lid member, and the connecting arm is mechanically linked to the foot pedal. When the foot pedal is stepped on, the mechanical link between the foot pedal and the connecting arm transmits a force to the lid member which causes the lid member to pivot into the storage compartment. A portion of the connecting arm extending into the compartment is preferably oriented along a line passing through the lid member pivoting axis in order to efficiently pivot the lid member.

The mechanical mechanism may also include a connecting rod in mechanical connection between the foot pedal and the connecting arm. The connecting rod is, preferably, pivotally connected to the foot pedal, and more preferably, pivots from a line perpendicular to a plane defined by a portion of the foot pedal at least twenty degrees in all directions.

The mechanical mechanism may include a bushing member in contact with a top surface of the foot pedal. The connecting rod is connected to the bushing member, and preferably passes through the bushing member and into the foot pedal.

The mechanical mechanism may also include a stop mechanism which prevents the lid member from pivoting outwardly from the cabinet. The stop mechanism may include a flexible tension member mechanically linked between the lid member and another portion of the cabinet. The stop mechanism may also include a first stop member attached to the connecting rod, and a second stop member disposed within the storage compartment in a manner such that the first and second stop members contact one another and prevent the lid member from pivoting outwardly from the cabinet.

When a stop mechanism having a first and second stop member is used, the first stop member preferably has a section extending outwardly from a first predetermined location on the connecting rod; and the second stop member preferably has an aperture through which the connecting rod is slidably disposed. The aperture of the second stop member has dimensions sufficient to prevent the first stop member from passing therethrough.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
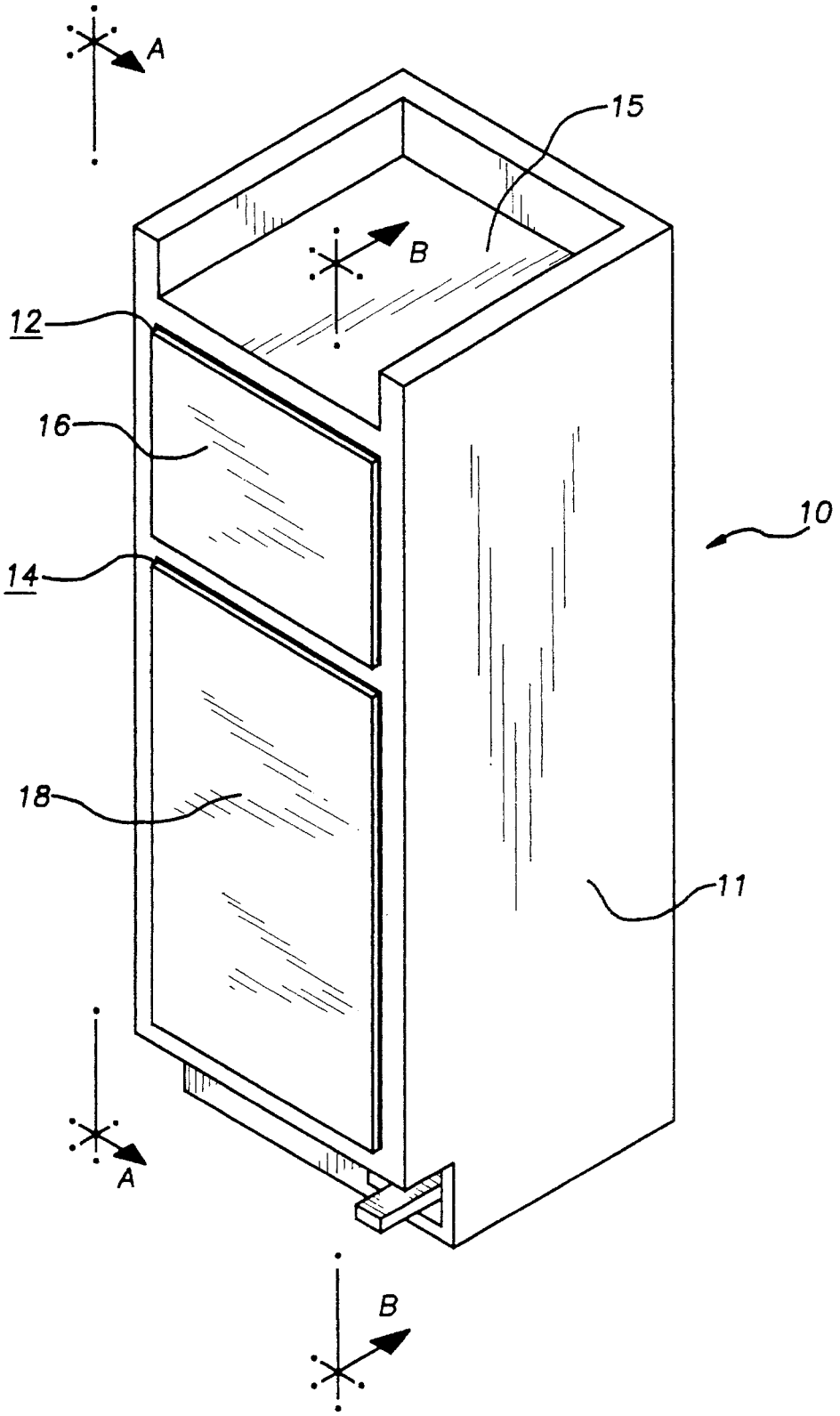
FIG. 1 is an isometric view of an exemplary embodiment of the improved waste container cabinet of the present invention.

FIG. 1 is an isometric view of an exemplary embodiment of the improved waste container cabinet of the present invention generally designated by the numeral 10. Cabinet 10 includes an outer housing 11 having a first vertically oriented aperture 12, a second vertically oriented aperture 14, and a substantially planar tray storage area 15. A vertically oriented pivoting lid member 16 is pivotally installed within first aperture 12. A vertically oriented door member 18 is hingedly installed within second aperture 14.

Figure 2:
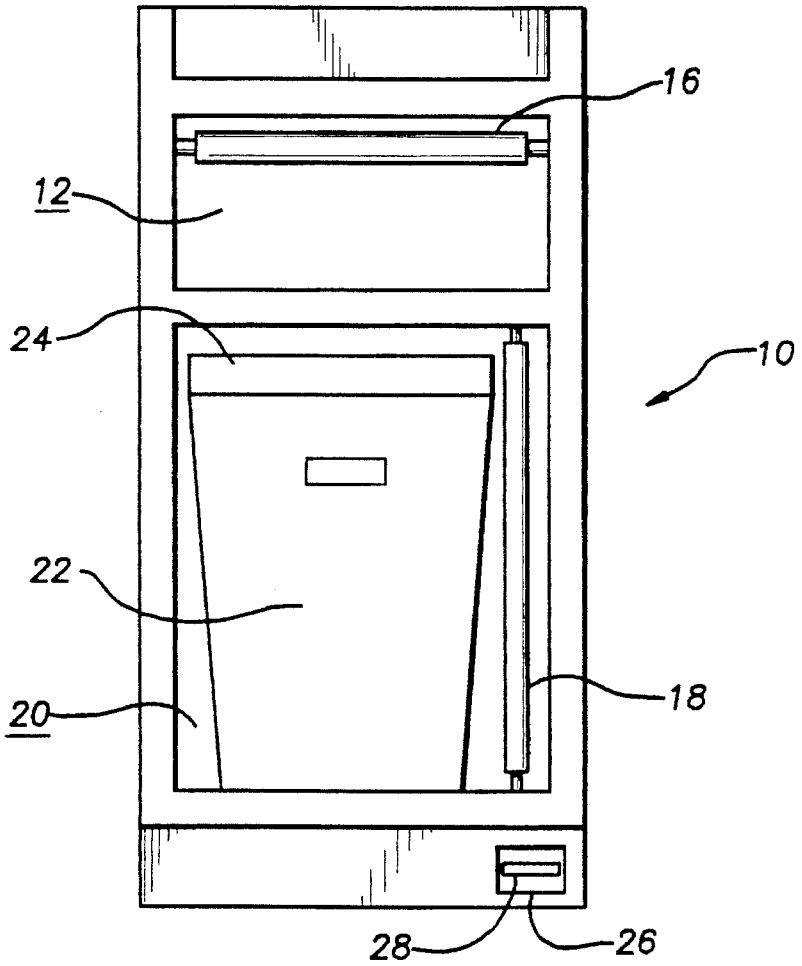
FIG. 2 is a front view of the cabinet of FIG. 1.

FIG. 2 is a front view of the cabinet 10 of FIG. 1 with door member 18 in the open position showing the waste can storage chamber 20 with a waste can 22 disposed therein, and lid member 16 pivoted inward into storage chamber 20. Waste can 22 has an open top 24 which is located beneath first aperture 12. A foot pedal aperture 26 is located at the front, right, bottom portion of housing 11. A portion of a foot pedal 28 is shown extending out through pedal aperture 26.

Cabinet 10 includes a mechanical mechanism having a foot pedal assembly, a connecting rod assembly and a bracket member.

Figure 3:
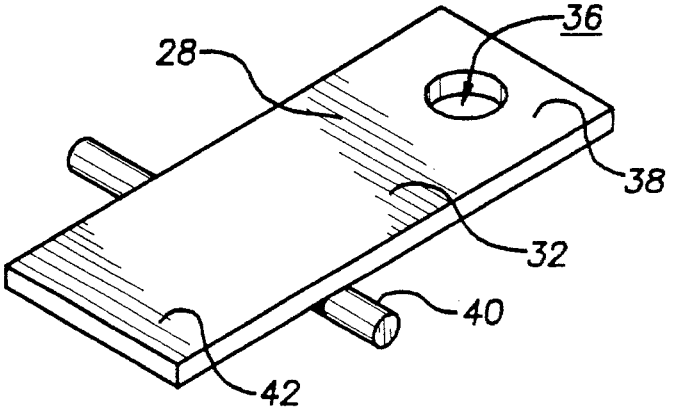
FIG. 3 is an isometric view of a foot pedal assembly.

FIG. 3 shows a foot pedal assembly 32. Foot pedal assembly 32 includes a foot pedal 28 which has a connecting rod aperture 36 located at one end 38, and a fulcrum pin 40 which is secured to the underside of foot pedal 28 about midway between end 38 and end 42. Fulcrum pin 40 extends out past the sides of foot pedal 28 and are inserted within a holding bracket on the sidewalls of pedal aperture 26.

Figure 4:
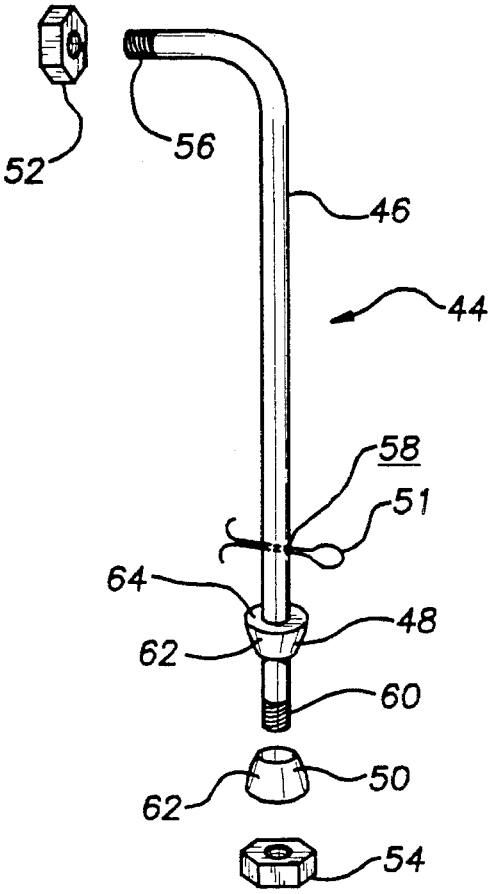
FIG. 4 is a side view of a connecting rod assembly.

FIG. 4 shows connecting rod assembly 44. Connecting rod assembly 44 includes a connecting rod 46, a first bushing 48, a second bushing 50, a cotter pin 51 and first and second threaded locking nuts 52, 54. Connecting rod 46 has about a ninety degree bend near a first threaded end 56 and a cotter pin aperture 58 near a second threaded end 60. Cotter pin 51 is installed through pin aperture 58.

First and second bushings 48, 50 each have an aperture therethrough leading between a spherical surface 62 and a substantially planar surface 64. Second threaded end 60 is installed through the aperture of first bushing 48 with the spherical surface directed toward end 60.

Figure 5:
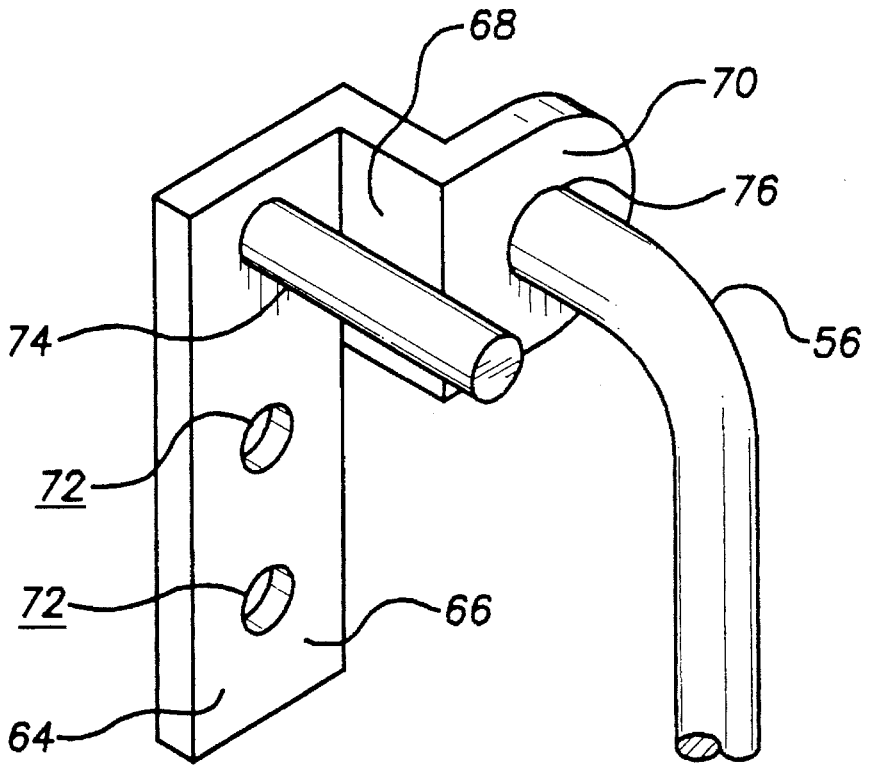
FIG. 5 is an isometric view of a bracket member in connection with a first end of a connecting rod.

FIG. 5 shows a bracket member 64. Bracket member 64 includes a planar section 66, an extension arm 68 and a connecting arm 70. Planar section 66 has two screw apertures 72 and a cylindrical pivot pin 74. Connecting arm 70 has a connecting rod aperture 76 through which first threaded end 56 is inserted prior to threading locking nut 52 thereon.

Figure 6:
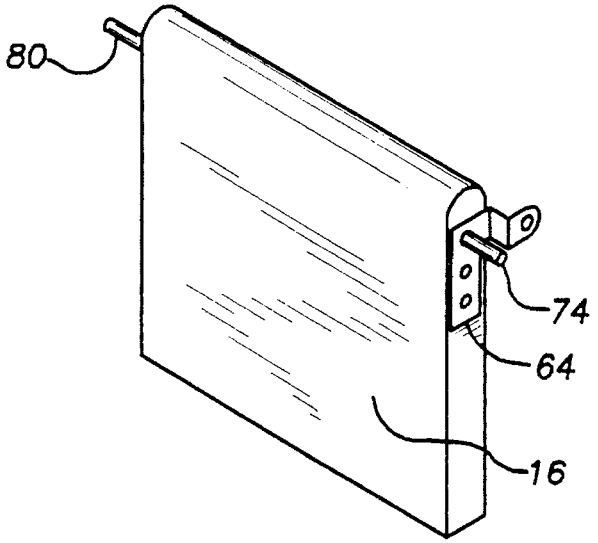
FIG. 6 is an isometric view of the bracket member of FIG. 5 attached to a lid member.

FIG. 6 shows bracket member 64 installed on lid member 16. Bracket member 64 is installed such that pivot pin 74 is in line with a second pivot pin 80.

Figure 7:
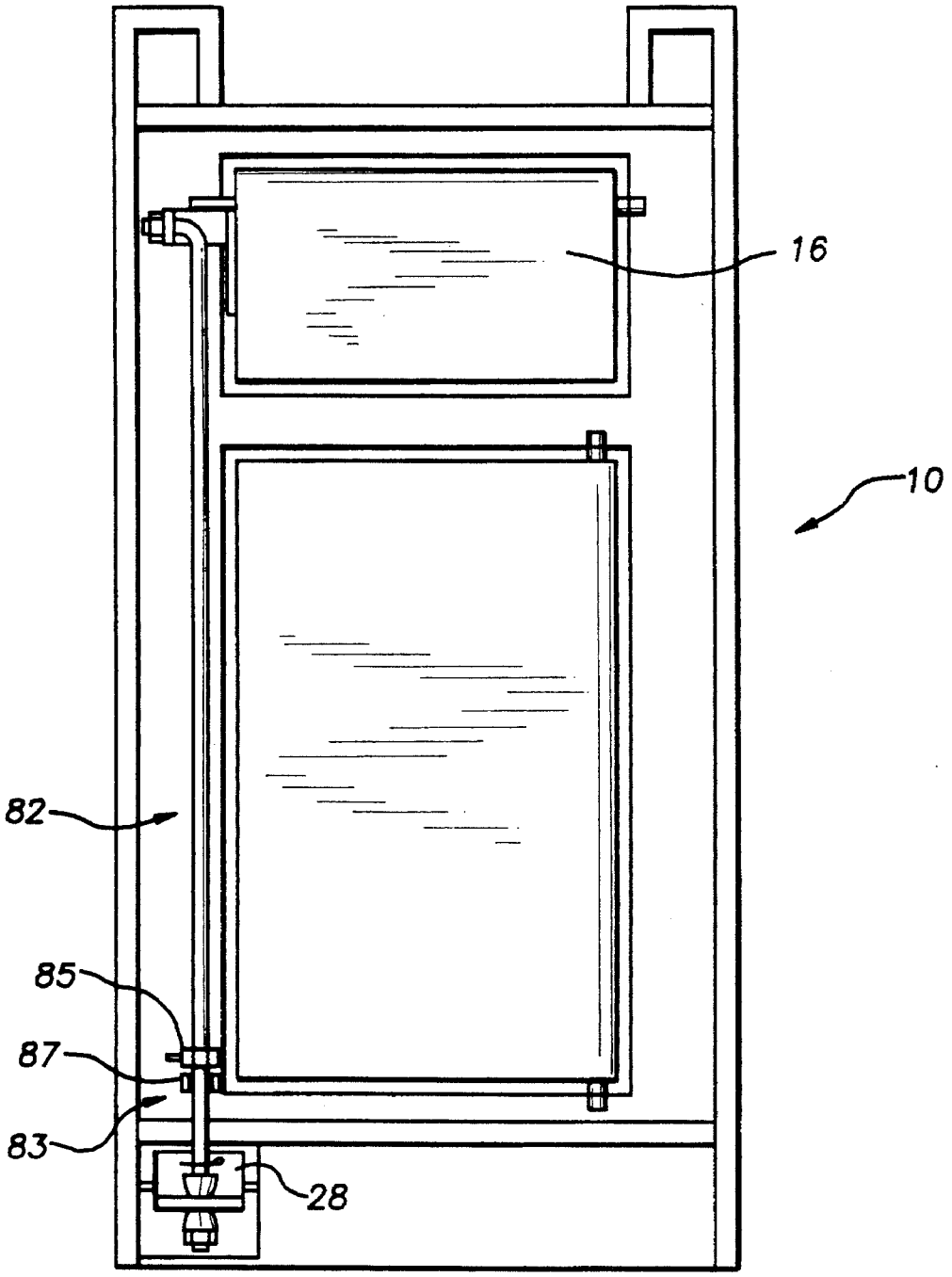
FIG. 7 is a cross-sectional, rear view of the cabinet along the line A—A of FIG. 1.

FIG. 7 is a cross-sectional, rear view of cabinet 10 along the line A—A shown in FIG. 1. The figure shows an assembly mechanical mechanism generally designated by the numeral 82 installed with cabinet 10. Foot pedal 28 in the fully up position and lid member 16 in the closed position. Also shown is a preferred stopping mechanism, generally referred to by the numeral 83. Stopping mechanism 83 includes a bushing 85 and a forked member 87.

Figure 8:
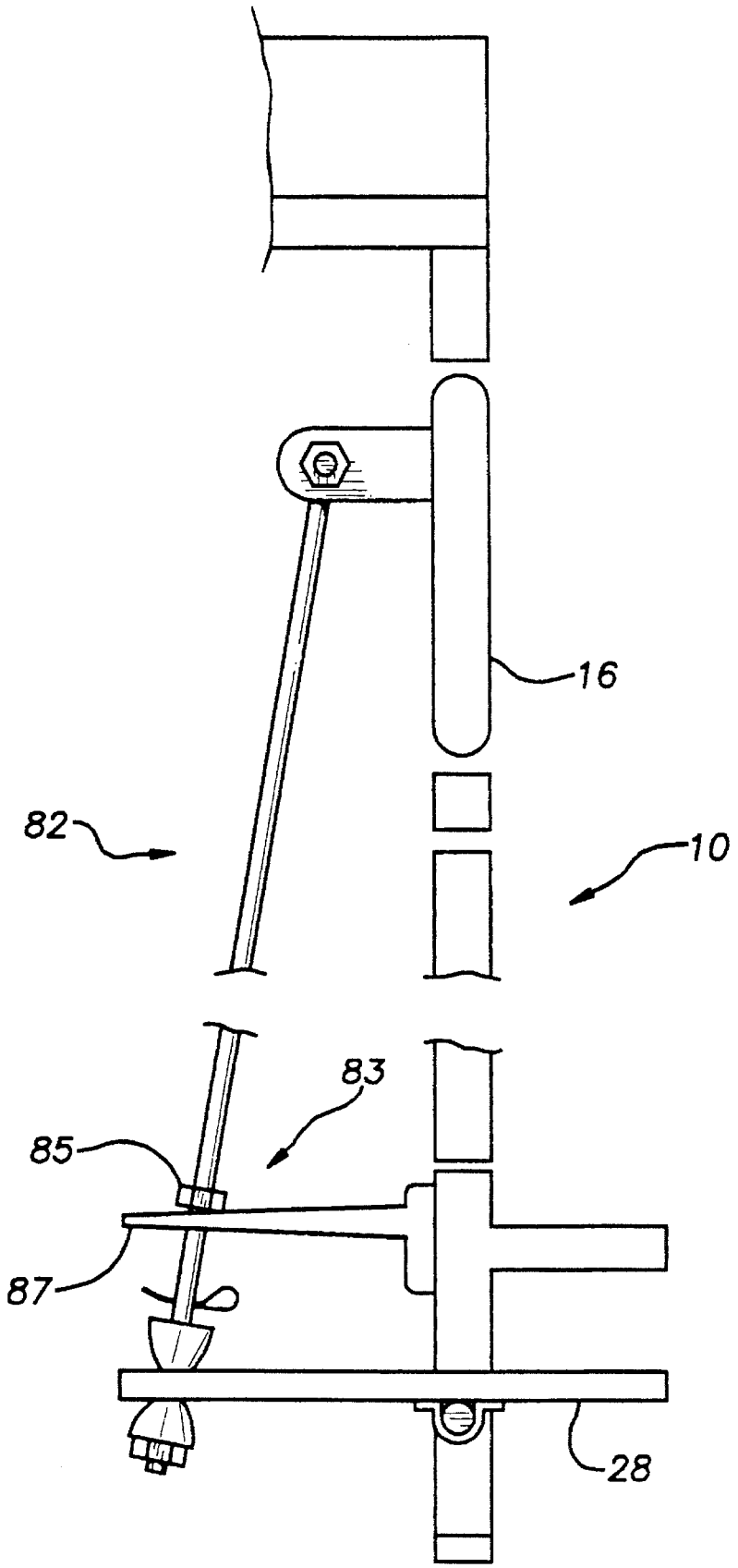
FIG. 8 is a cross-sectional, side view of the cabinet along the line B—B of FIG. 1 with the lid member in the closed position.

FIG. 8 is a cross-sectional, side view of cabinet 10 along the line B—B shown in FIG. 1. The figure shows mechanical mechanism 82 with foot pedal 28 in the fully up position and lid member 16 in the closed position. also shown is a side view of bushing 85 and forked member 87 of stopping mechanism 83.

Figure 9:
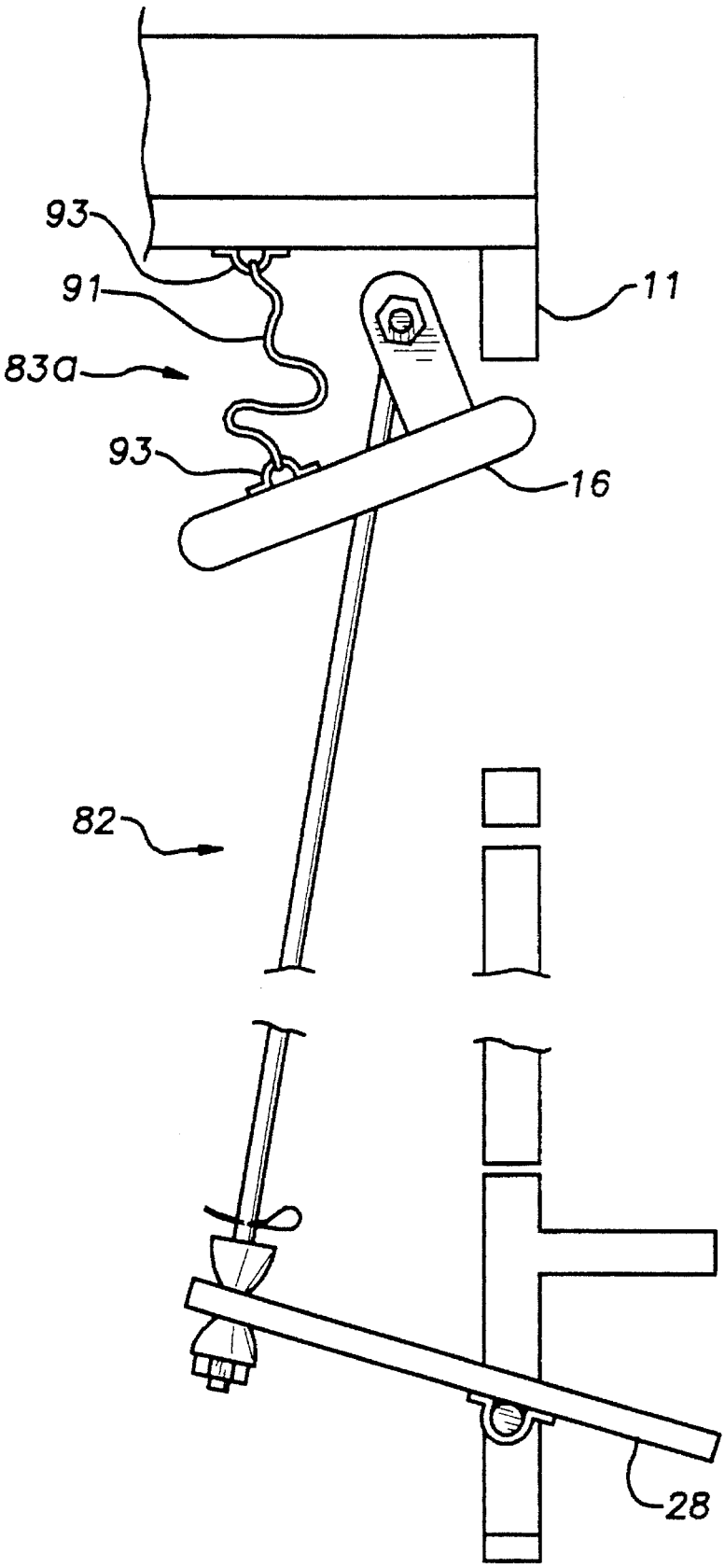
FIG. 9 is a cross-sectional, side view of the cabinet along the line B—B of FIG. 1 with the lid member in the open position.

FIG. 9 is a cross-sectional, side view of cabinet 10 along the line B—B shown in FIG. 1. The figure shows mechanical mechanism, 82 with foot pedal 28 in the fully depressed down position and lid member 16 in the open position. Also shown is a second stopping mechanism **83*a* which includes a length of steel cable 91 and two securing brackets 93. The length of cable 91 is selected to prevent lid member 16 from pivoting outward from housing 11**.

Use of the waste container cabinet 10 is as simple as depressing foot pedal 28 with your foot to open lid member 16. Once the refuse has been placed through aperture 12 lid member 16 is moved to the closed position by removing your foot from foot pedal 28.

It can be seen from the preceding description that a device for allowing patrons in a fast-food dining facility to dispose of their own refuse without having to contact the waste container cabinet with their hands, which has a foot actuated pivoting lid member has been provided.

It is noted that the embodiment of the hands free waste container cabinet described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. In a waste container cabinet of a type having a storage compartment, for receiving a waste container having an operator; a first vertically oriented aperture, located above the open top of the waste container; and a vertically oriented pivoting lid member, disposed within the first vertically oriented aperture; an improvement comprising:

mechanical means, in mechanical connection with said pivoting lid member, for causing said pivoting lid member to pivot out of said first vertically oriented aperture and into said storage compartment in a manner such that a user may place refuse within a waste container that is disposed within said storage compartment without contacting said pivoting lid member with his/her hands, said mechanical means including:

a foot pedal that extends from a bottom section of said cabinet;

a lid bracket that is attached to said pivoting lid member and that has a connecting arm that extends into said storage compartment, said connecting arm being mechanically linked to said foot pedal by a connecting rod that is pivotally connected between said foot pedal and said connecting arm, said connecting arm having a bushing member that is in pivoting contact with said foot pedal, said connecting rod passing through said bushing member, said mechanical means causing said pivoting lid member to pivot in response to a force directed against said foot pedal in a first direction.

2. In a waste container cabinet of a type having a storage compartment, for receiving a waste container having an open top; a first vertically oriented aperture, located above the open top of the waste container; and a vertically oriented pivoting lid member, disposed within the first vertically oriented aperture; an improvement comprising:

mechanical means, in mechanical connection with said pivoting lid member, for causing said pivoting lid member to pivot out of said first vertically oriented aperture and into said storage compartment in a manner such that a user may place refuse within a waste container, disposed within said storage compartment, without contacting said pivoting lid member with his/her hands, said mechanical means including:

a foot pedal that extends from a bottom section of said cabinet;

a lid bracket that is attached to said pivoting lid member and that has a connecting arm that extends into said storage compartment, said connecting arm being mechanically linked to said foot pedal by a connecting rod that is pivotally connected between said foot pedal and said connecting arm; and a stop mechanism for preventing said pivoting lid member from pivoting outwardly from said cabinet, said stop mechanism including a first stop member attached to said connecting rod, and a second stop member disposed within said storage compartment in a manner such that said first and second stop members contact one another and prevent said pivoting lid member from pivoting outwardly from said cabinet, said first stop member having a section extending outwardly from a first predetermined location on said connecting rod, said second stop member having an aperture through which said connecting rod is slidably disposed, said aperture having dimensions sufficient to prevent said first stop member from passing therethrough, said mechanical means causing said pivoting lid member to pivot in response to a force directed against said foot pedal in a first direction.

3. In a waste container cabinet of a type having a storage compartment, for receiving a waste container having an open top; a first vertically oriented aperture, located above the open top of the waste container; and a vertically oriented pivoting lid member, disposed within the first vertically oriented aperture; an improvement comprising:

a pivoting lid member opening mechanism comprising:

a foot pedal extending from a bottom section of said cabinet;

a lid bracket, attached to said pivoting lid member, having a connecting arm extending into said storage compartment; and a connecting rod pivotally connected between said foot pedal and said connecting arm in a manner such that said pivoting lid member pivots in response to a force directed against said foot pedal in a first direction, said pivotal connection between said connecting rod and said foot pedal including a bushing member in contact with said foot pedal and through which said connecting rod passes.

* * * * *